US006860259B2

(12) United States Patent
Rice et al.

(10) Patent No.: US 6,860,259 B2
(45) Date of Patent: Mar. 1, 2005

(54) PAINTBALL GUNS

(75) Inventors: John Ronald Rice, Stoke-on-Trent (GB); Nicholas John Marks, Stoke-on-Trent (GB)

(73) Assignee: NPF Limited, Birmingham (GB)

( * ) Notice: Subject to any disclaimer, the term of this patent is extended or adjusted under 35 U.S.C. 154(b) by 0 days.

(21) Appl. No.: 10/856,193

(22) Filed: May 28, 2004

(65) Prior Publication Data

US 2004/0216727 A1 Nov. 4, 2004

Related U.S. Application Data

(60) Division of application No. 10/325,480, filed on Dec. 20, 2002, now Pat. No. 6,748,938, which is a continuation of application No. 09/947,673, filed on Sep. 6, 2001, now abandoned, which is a continuation of application No. 09/418,224, filed on Oct. 14, 1999, now Pat. No. 6,311,682, which is a continuation-in-part of application No. 09/272,652, filed on Mar. 18, 1999, now abandoned.

(30) Foreign Application Priority Data

Jan. 22, 1999 (GB) ..... 9901288
Jul. 16, 1999 (GB) ..... 9916688

(51) Int. Cl.[7] ..... F41B 11/00
(52) U.S. Cl. ..... 124/77; 124/56
(58) Field of Search ..... 124/77, 56, 71, 124/73, 72, 74; 42/84

(56) References Cited

U.S. PATENT DOCUMENTS 1,512,022 A 10/1924 Hendrickson
2,359,032 A 9/1944 Gott
2,747,607 A 5/1956 Matasovic
3,139,902 A 7/1964 Thomas
3,250,292 A 5/1966 Mollick
3,711,638 A 1/1973 Davies (List continued on next page.)

FOREIGN PATENT DOCUMENTS

| | | |
|---|---|---|
| DE | 274479 | 7/1988 |
| GB | 2259559 | 7/1991 |
| GB | 2290483 | 6/1994 |
| GB | 2342710 | 4/2000 |

OTHER PUBLICATIONS

Website by Corinthian Media Services, website link: http://www.warpig.com/com/paintball/tournament/wc97/wc97.4.ram.

"What an Angel" (article re Angel V6 Gear Special), PGI product catalog, Mar. 1997, pp. 74–75*.

Website link: http://archive.bibalex.org/web/19980113163202/http://pneuventures.com.

Website dated Jul. 3, 1998. Pages from Oct. 1997 (No. 103) edition of Paintball Guns International; Title: "Warrior".

WDP Ltd., "Angel™ Operators Manual" No. 2; Angel users guide, brochure.

*Primary Examiner*—Teri P. Luu
*Assistant Examiner*—Stephen A. Holzen
(74) *Attorney, Agent, or Firm*—Foley & Lardner LLP

(57) ABSTRACT

An electronically controlled pneumatic paintball gun, comprising means for monitoring and/or controlling one or more parameters of the gun's operation and alphanumeric display means for displaying data related to said monitoring or control on a display panel integral with the gun.

1 Claim, 3 Drawing Sheets

U.S. PATENT DOCUMENTS 3,798,796 A 3/1974 Stauff
3,842,526 A 10/1974 Dixon
4,019,180 A 4/1977 Graves
4,148,245 A 4/1979 Steffanus et al.
4,189,143 A 2/1980 Van Auken et al.
4,205,589 A 6/1980 Engler et al.
4,220,992 A 9/1980 Blood et al.
4,256,013 A 3/1981 Quitadama
4,541,191 A 9/1985 Morris et al.
4,694,850 A 9/1987 Fumino
4,718,187 A 1/1988 Blake
4,770,153 A 9/1988 Edelman
4,777,864 A * 10/1988 Siech et al. ..... 89/45
4,802,504 A 2/1989 Politi
5,044,107 A 9/1991 Holford
5,062,232 A 11/1991 Eppler
5,083,392 A 1/1992 Bookstaber
5,084,695 A 1/1992 Freeman
5,140,144 A 8/1992 Shepard
5,142,805 A 9/1992 Horne et al.
5,181,009 A 1/1993 Perona
5,280,778 A 1/1994 Kotsiopoulos
5,303,495 A 4/1994 Harthcock
5,448,847 A 9/1995 Teetzel
5,459,957 A 10/1995 Winer
5,559,490 A 9/1996 McDonald et al.
5,564,211 A 10/1996 Mossberg et al.
5,566,486 A 10/1996 Brinkley
5,566,934 A 10/1996 Black et al.
5,570,528 A 11/1996 Teetzel
5,614,679 A 3/1997 Johnson
5,642,581 A 7/1997 Herold et al.
5,668,803 A 9/1997 Tymes et al.
5,675,925 A 10/1997 Wurger
5,704,151 A 1/1998 West et al.
5,704,153 A 1/1998 Kaminski
5,727,538 A 3/1998 Ellis
5,736,720 A 4/1998 Bell et al.
5,755,056 A 5/1998 Danner et al.
5,782,028 A 7/1998 Simon et al.
5,791,328 A * 8/1998 Alexander ..... 124/76
5,826,360 A 10/1998 Herold et al.
5,831,261 A 11/1998 Plesko
5,834,676 A 11/1998 Elliott
5,881,707 A 3/1999 Gardner, Jr.
5,896,691 A 4/1999 Kaminski et al.
5,947,738 A 9/1999 Muehle et al.
5,949,015 A 9/1999 Smith et al.
5,953,844 A 9/1999 Harling et al.
5,954,507 A 9/1999 Rod et al.
5,967,133 A 10/1999 Gardner, Jr.
6,003,504 A 12/1999 Rice et al.
6,009,900 A 1/2000 Elgert et al.
6,035,843 A 3/2000 Smith et al.
6,039,574 A 3/2000 Standiford et al.
6,062,208 A 5/2000 Seefeldt et al.
6,138,656 A 10/2000 Rice et al.
6,142,137 A 11/2000 MacLaughlin
6,171,190 B1 1/2001 Thanasack
6,223,461 B1 5/2001 Mardirossian
6,226,913 B1 5/2001 Haimovich et al.
6,237,271 B1 5/2001 Kaminski
6,286,242 B1 9/2001 Klebes
6,305,367 B1 10/2001 Kotsiopoulos et al.
6,311,682 B1 11/2001 Rice et al.
6,314,671 B1 11/2001 Gering
6,321,478 B1 11/2001 Klebes
6,345,461 B1 2/2002 Constant et al.
6,392,613 B1 5/2002 Goto
6,415,542 B1 7/2002 Bates et al.
6,421,943 B1 7/2002 Caulfield et al.
6,477,801 B1 11/2002 O'Dwyer
6,510,642 B2 1/2003 Riener
6,565,438 B2 5/2003 Ogino
6,637,421 B2 * 10/2003 Smith et al. ..... 124/77
2001/0008848 A1 7/2001 Armstrong
2002/0103026 A1 8/2002 Himoto et al.
2002/0170552 A1 11/2002 Gardner
2003/0061753 A1 4/2003 Glock
2003/0070343 A1 4/2003 Glock
2003/0085523 A1 5/2003 Spaulding et al.
2003/0144056 A1 7/2003 Leifer et al.

* cited by examiner

PAINTBALL GUNS

CROSS-REFERENCE TO RELATED APPLICATION(S)

This application is a continuation of application Ser. No. 10/325,480, filed Dec. 20, 2002 now U.S. Pat. No. 6,748,938 which is a continuation of application Ser. No. 09/947,673, filed Sep. 6, 2001, now abandoned, which is a continuation of application Ser. No. 09/418,224, filed Oct. 14, 1999, now U.S. Pat. No. 6,311,682, which is a continuation-in-part of application Ser. No. 09/272,652, filed Mar. 18, 1999 now abandoned. The entire contents of both applications are incorporated herein by this reference.

BACKGROUND OF THE INVENTION

This invention relates to paintball guns.

The game of paintball involves participants carrying guns which fire pellets of "paint" or dye which are fired from the gun and burst upon impact to leave a mark at the point of impact.

Most paintball guns use a pneumatic system for firing the paintballs using compressed air or other gas. More recently, such pneumatically operated guns have begun to be electronically controlled for greater effectiveness.

SUMMARY OF THE INVENTION

According to the present invention there is provided an electronically controlled pneumatic paintball gun, comprising monitoring and/or controlling apparatus for monitoring and/or controlling one or more parameters of the gun's operation and alphanumeric means for displaying data related to said monitoring or control on a display panel integral with the gun.

The display panel is most preferably mounted on the cheek of the gun.

BRIEF DESCRIPTION OF THE DRAWINGS

Embodiments of the invention will now be described, by way of example only, with reference to the accompanying drawings in which.

DESCRIPTION OF THE PREFERRED EMBODIMENTS OF THE INVENTION

A paintball gun embodying the present invention uses a compressed gas circuit supplied with gas from a gas cylinder to eject projectiles in the form of spheres containing paint which break upon impact. The gun is electronically controlled, typically by a microswitch operated upon by a trigger squeezed by a user's finger and the electronics control the firing mechanism and in particular ensure correct timing. The electronics also enable various different modes of firing, such as a semi-automatic mode in which each trigger actuation causes a projectile to be fired, typically up to 20 times a second, or a fully automatic mode in which a single trigger actuation causes a burst of a selectable number of shots. Other parameters such as dwell time, firing rate, number of bursts per second, and so on are also selectable under the operation of the control electronics. A paintball gun of this type is commercially available as the Angel™ gun manufactured by NPF Limited and reference is made to U.S. patent application Ser. No. 09/137,641.

Figure 1:
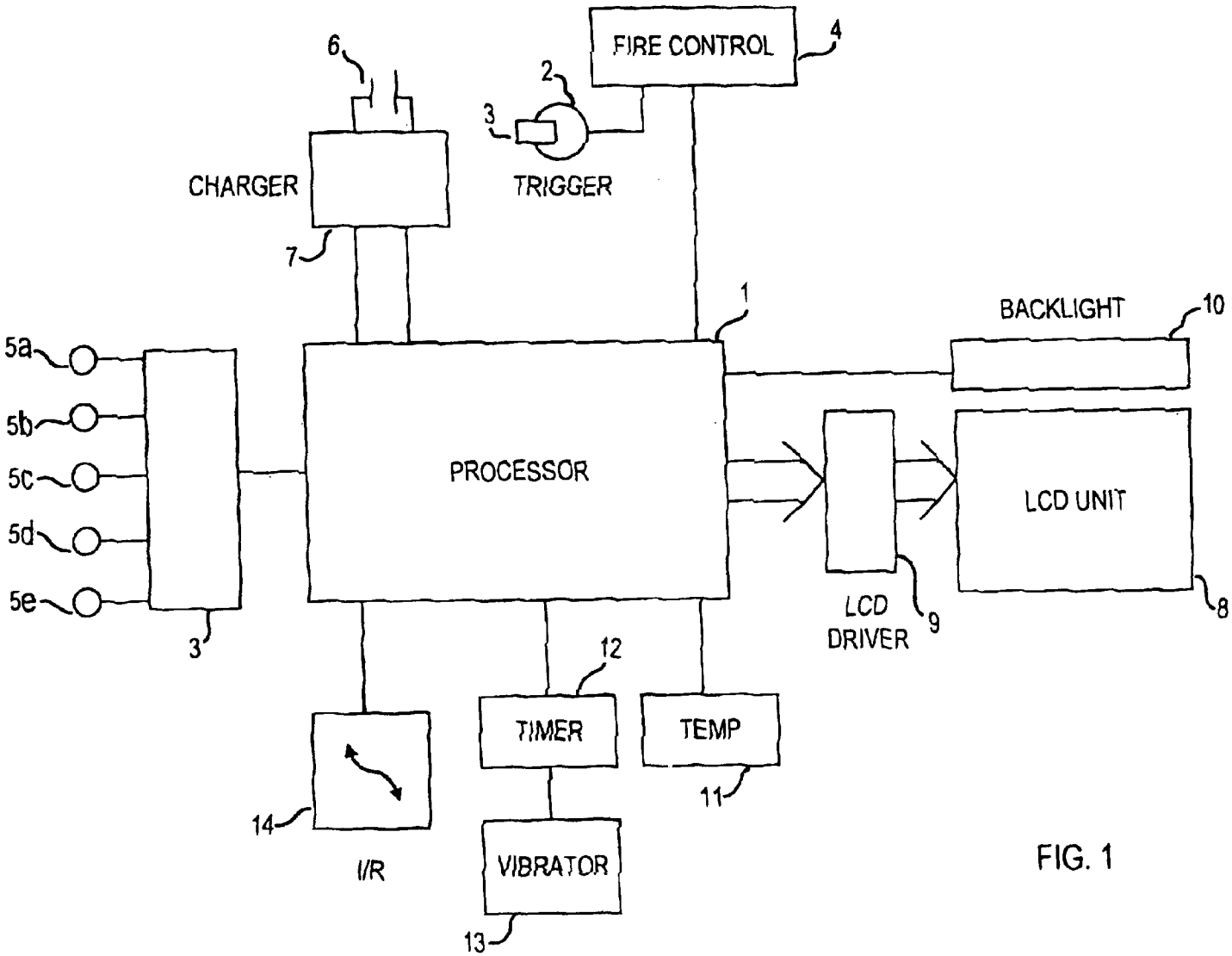
FIG. 1 shows schematically an electronic apparatus for use in a paintball gun.

FIG. 1 shows a control and display apparatus for use in a gun according to the present invention. The apparatus comprises a central processor 1 which typically includes a microprocessor. As described, operation of the gun is initiated by a user depressing a trigger 2 which acts upon a microswitch in known manner. This sends an appropriate signal to fire control/monitoring circuitry 4, which may be at least partially incorporated in the control unit 1 and which can be used to control the rate of fire, dwell time, etc, and also to fire the gun when the trigger has been operated, using the mode designated by the user. These modes may be, for example, manual, semi-automatic or automatic modes or other modes as required or as allowed by the rules of the particular event or tournament he is playing in. These operate in known manner.

A plurality of input buttons 5*a* to 5*e* are arranged to provide user input to the processor 1 via a user interface 3 and these have several different functions as will be outlined below.

The gun is powered by a battery 6 which is preferably a rechargeable type and which can charge through a battery charger 7 which has a mains input.

An integral alphanumeric display unit in the form of an LCD unit 8, driven by an LCD driver circuit 9 is connected to the processor and this displays various types of data and information. Preferably, a back-light 10 is also provided to enable better viewing of the LCD unit but which back-light may be turned off when required. The alphanumeric display need not necessarily be an LCD display.

Various other pieces of apparatus, sensors, etc, may be added to the control unit and non-limiting examples of these are shown in FIG. 1. There is shown a temperature sensor 11, a timer 12 and a vibrator 13. The timer 12 can be used for various purposes such as for timing a paintball game and for an alarm function and the vibrator 13 may be used as the alarm indicator for the timer 12. In addition, an infrared link 14 is provided which enables programming of the control unit, or by directional data exchange, to take place from a remote PC or other device fitted with a similar infrared unit. Infrared communication devices are well known. A serial link, e.g. RS232C, or other communications link may also be provided.

Figure 2:
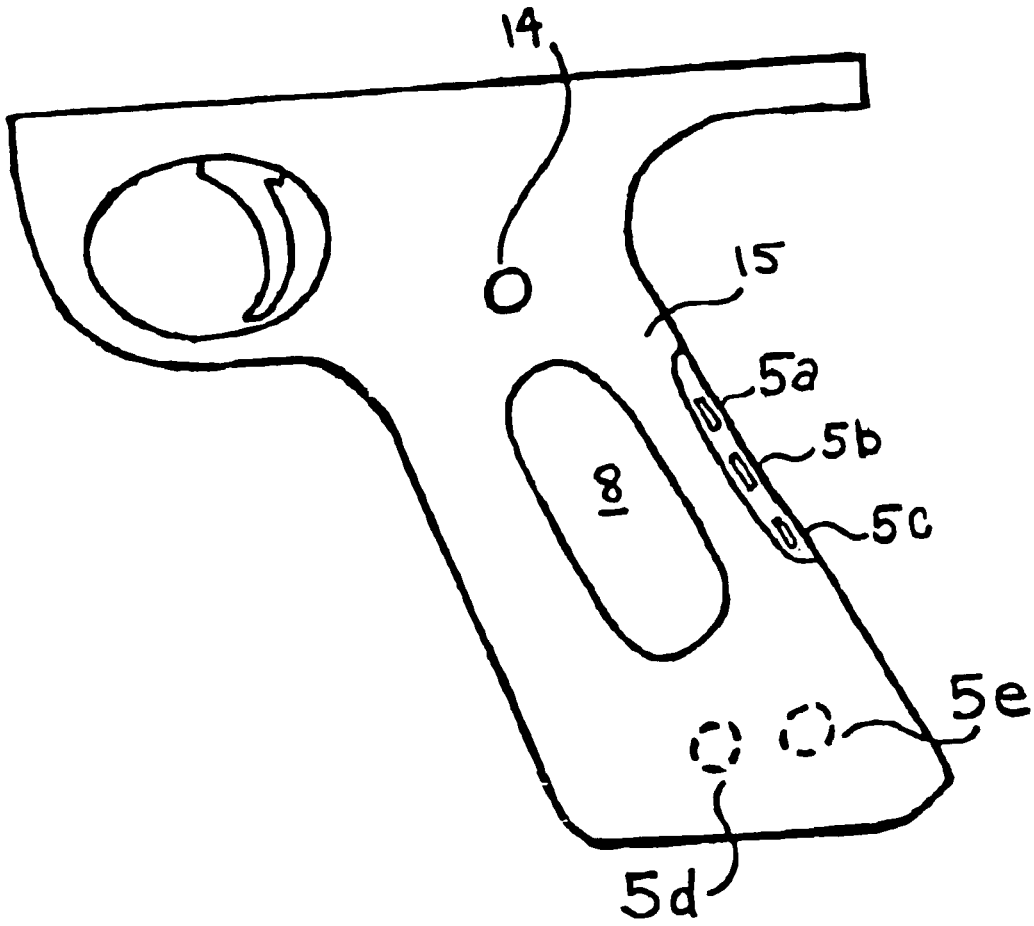
FIG. 2 shows the handle of a gun.
Figure 3:
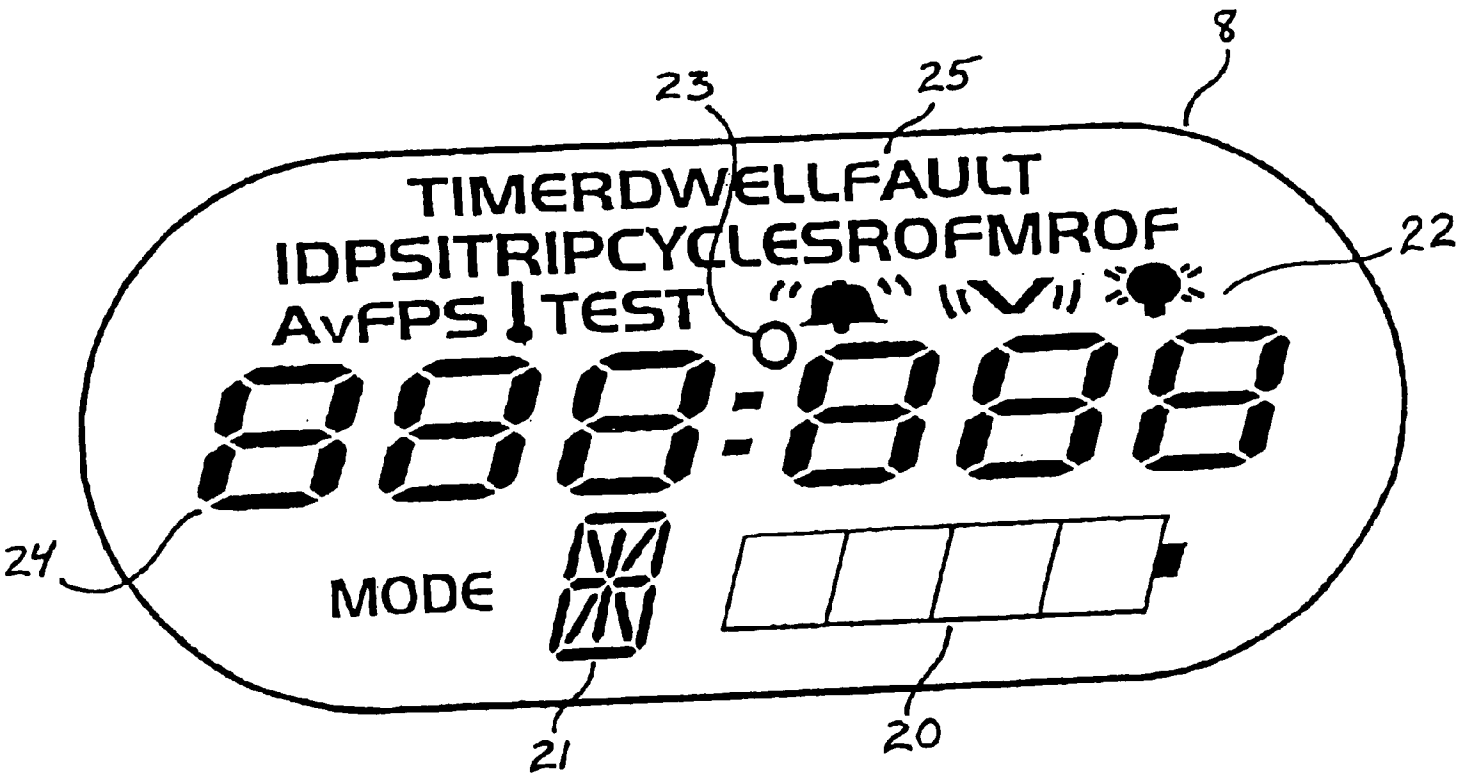
FIG. 3 shows a display.

FIG. 2 shows the grip frame part of a paintball gun. The user holds the grip in the normal manner and squeezes the trigger 2 to fire the gun. As shown, the gun is radically different from previous paintball gun designs in that an LCD display 8 is integral with and incorporated into the gun, in this case on the cheek of the grip frame 15. It could, however, be mounted in any other position/disposition on the gun itself. The control buttons are also distributed on the grip frame. Three of the buttons 5*a*, 5*b* and 5*c* are mounted in a recessed portion where they are always accessible. The remaining buttons in this embodiment are mounted under a cheek plate (not shown) which is screwed or otherwise attached over the cheek, possibly using anti-tamper means, or tamper-indicating means such as seals, and thus are only accessible when the plate is removed. This is because these buttons are used, as described below, to alter various functions of the gun which affect its performance, rate of fire, etc. In many events, the rate of fire or other gun parameters must be set before the game begins and cannot be altered once the match is underway. By being mounted in an inaccessible position, these buttons achieve this objective.

The various functions alterable and displayable on display 8 are as follows:

Various values and words are selectably displayed by a six character alphanumeric display 24 and a plurality of fixed words/characters which are illuminated as required. A battery indicator 20 is displayed at all times and goes from blank to full (all four segments displayed). When down to about 25% power level the last segment only is displayed, and this flashes indicating low power status.

A mode indicator 21 displays the mode of firing and may show single characters or numerals such as A, B, C, 1, 2, 3 etc. Modes are displayed at all times. The mode of firing can only be changed by one of the normally inaccessible tactile switches 5*d* or 5*e*. The modes available may be, for example, SEMI: (1 shot; 1 trigger pull), BURSTS: (a 3, 4, 5, 6, 7 or 8 shot burst per trigger pull), ZIPS (3, 4, 5, 6, 7, 8 shot bursts at a rate of 8.75 shots/sec max). The MROF (Maximum Rate of Fire) function will display 8 when in the ZIP modes.

The vibrator may work in a timer mode for indicating, for example, 5 min intervals by actuating the vibrator for 3 secs. Note: if the 'V' mode is selected the 'V' is displayed on the LCD. Switching the vibratory alarm ON or OFF is selected from a sub-menu function.

Temperature may be displayed in ° F. or ° C. by the main alphanumeric display 24. A temperature icon is only displayed when the menu calls for it. Temp mode can be selected from the menu; Changing from Centigrade to Fahrenheit is selected from the sub-menu.

A trip meter is a shot counter that can be re-zeroed by the consumer. Trip can be selected from the menu. Resetting to zero is selected from the sub-menu.

A ROF (Rate of Fire) function may measure a string of shots over a selected (eg 1 second) period. The first shot starts the counter for 1 second, any shots that occur in that period are registered on the display. Then the display will not accept any input for a 3-second period. During this period the display will also flash before an additional cycle may start. The ROF mode can be selected from the menu. The data is constantly updated and so no sub-menu is required.

The display can accordingly display not only a desired rate of fire, but also the rate of fire actually achieved by the user, which can fall well short of the desired rate-of fire, or could even exceed it for a very skilled marksman. Furthermore, competition rules may set an upper limit on the rate of fire, and this upper limit may be programmed in and displayed on the LCD display (MROF). More details are set out further below.

To power off the gun a tactile switch on the grip must be held for 1.5 seconds which shows the whole display for 2 seconds. Then the display shows the word "SAFE" and the back light switches OFF. The gun cannot fire in the safe mode but the battery meter is still displayed. An automatic power off function may be provided which powers off the gun if no shots are fired for a predetermined period, e.g. 60 minutes.

A unique ID number may be programmable into the gun by the manufacturers or suppliers. This number may affect, e.g. restrict, the modes it is possible for the gun to be fired in and can render the gun less likely to be stolen.

Numerous fault codes can be displayed, for example Fault 1, F1=Over temp=38° C., F2=Under temp=0° C., and so on. The fault can be selected from the menu. Should more than one fault be present the display will alternate at 2-sec cycles. The faults will only clear from the display when the fault condition is removed.

Dwell time may be displayed, e.g. in millisecs=e.g. 0:20=20 ms. Dwell is changed via a tactile button and scrolls from 12 ms to 25 ms.

MROF displays the rate of fire as shots per sec, e.g. 12=12 shots/sec. MROF may be selected from the menu but can only be changed via one of the normally inaccessible tactile buttons on the board. In one embodiment the range is 5 to 20 shots per second.

Note: If a mode of fire has a preset rate this will be displayed under the MODE function and cannot be adjusted whilst in that mode.

A cycles counter is a grand total shot counter that cannot be reset by the consumer, only by the suppliers of the gun or other authorised person.

A TRIP counter is provided, which is a shot counter that can be zeroed by the user or consumer.

A timer is a countdown timer which can, for example, count down from 60 min. At the end of the count the vibrator alarm may be activated for 10 seconds. The timer can be set in 5-min increments, i.e. OFF, 5, 10, 15 etc. A sub-menu allows changes. The settings must remain in the memory even after power has been removed.

The display may also indicate test modes and a BACK-LIGHT ON symbol 22 is included. Additional functions displayable include, inter alia, velocity, average velocity, gas pressure and gas usage, for example.

In one embodiment DWELL, MROF, MODE and TIMER functions are stored in non-volatile memory since these settings must be retained even when power is removed.

The button functions may be as follows in one embodiment

Button 5*a*

Gun on/off when held for 1.5 seconds

Display "-live-" when on at all times unless timer started via activation to ready state via switch 4 and pulse vibrator for 3 seconds as confirmation. NOTE; menu switch 5*b* is inactive whenever the gun is in "-live-" or timer ready/timer active mode. NOTE timer can only be made active via switch 4. When in timer ready state the timer will show the set time and flash between "-live-" and set time at 1 second intervals. When gun is in the "-live-"/timer ready status, timer starts when first shot is fired then the display will show the timer counting down. The arm will go off prior to time up. This feature allows the players to know when the game end is near and that they have a final opportunity to bring the game to a conclusion. Display "-safe-" when off and switch 5*b* is now active and timer stops. Battery status to be displayed at all times; mode status to be displayed at all times even when "-safe-".

Button 5*b*

Menus active only when the gun is "-safe-". No access if the gun is "live".

FAULT—display "none" if no fault present

ID—display unique ID number

ROF—display the maximum rate of fire achieved measure between two shots

TIMER—display set time

VIBRATOR—display status

LIGHTS—display status

TEMP—display temperature

CYCLES—display total cycles

TRIP—display trip cycles

Button 5*c*

Sub menus note; no access if gun is in "-live-" status. The timer is only available in "-live-" status when switch 5*c* only puts timer in ready state, first shot will start the timer.

FAULT—"none" or "code 1"

ID—no sub mode

ROF—set to zero

TIMER—from zero to sixty in five minute increments

VIBRATOR—no sub menu

Activate for two seconds

LIGHTS—on/off

TEMPERATURE—no sub menu

CYCLES—no sub menu

TRIP—reset to zero

Button 5*d*

No access granted if gun is in "-live-" state. When switch 5*d* is pressed gun will go into "-safe-" mode (gun cannot fire), then if no further button presses occur gun will display "-safe-" after 5 seconds Menus DWELL—display dwell time MROF—display set rate of fire, NOTE; zip modes to show 9 enhanced modes to have maximum display of 13, semi mode to have maximum possible display of 20.

MODE—display status, NOTE; mode can affect the MROF

FAULT—display "none" if no fault present

ID—display unique ID number

ROF—display the maximum rate of fire achieved measure between two shots

TIMER—display set time

VIBRATOR—display status

LIGHTS—display status

TEMP—display temperature

CYCLES—display total cycles

TRIP—display trip cycles

Button 5*c*

DWELL—scroll 10 to 24 milliseconds

MROF—display set rate of fire, NOTE; zip modes to show 9 enhanced modes to have maximum possible display of 2–13, semi mode to have maximum possible display of 2–20.

MODE—A=auto, B=semi, C-I=burst modes, J-P=zip modes, R-T=ramp modes, U-Z=other modes. If no mode is allocated, then selected digit flashes and "no Acc" is displayed. Also fault code "code 1" to be displayed. NOTE; mode can affect the MROF, which must adjust accordingly, ie: last MROF setting in modes also to be retained when switching between modes. EG: semi set at 13 shots sec/mode B then mode F selected set at 12 shots/sec.

FAULT—no sub menu

ID—no sub menu

ROF—set to zero

TIMER—0–60 minutes scrolled menu in 5 minute increments

VIBRATOR—On/Off

LIGHTS—On/Off

TEMP—F/C

CYCLES—no sub menu

TRIP—reset to zero

Other Features That Are Present in the Preferred Embodiment

A. FACTORY RESETS—press and hold buttons 5 and 6 together for 1.5 seconds. Display all lights up. The values may be:

TRIP—000

FAULTS—status

ID—status

ROF—0

TIMER—15 minutes

MODE—B (semi)

MROF—zips at 9 semi at 11 all enhanced at 11

DWELL—14

VIBRATOR—on

LIGHTS—off

TEMP—f

Cycles—status

B. The hopper system can be controlled via the gun to suit different parameters ie hopper in semi mode switched on when a rate of 2 shots/second are achieved. In all other modes hopper to switch on after first shot.

C. Codes are used to allow access to certain parameters of the gun, which one may not wish the consumer to have access to. IE: RS232/infrared link to have a code word which will give access to setting the ID number and resetting the CYCLES. Link remains connected for this operation. Menu on the screen hyperlink. RS232/infrared link may have a further code word which will give access to override the lock out status on the internal menus ie the internal menus can be worked on for 1 hour with the gun "live" then lockout reactivates, this countdown stating when the RS232 link is removed. This is required so the guns can be set up in assembly.

D. Power saving feature, ie Electronic Sleep occurs after 10 hours.

E. Should the battery be disconnected when reconnected the gun comes on in "-safe-" mode.

F. The power source is a rechargeable battery that can be recharged without removal from the gun.

What is claimed is:

1. A pneumatic paintball gun comprising:

a body;

a trigger operatively connected to the body;

a switch upon which the trigger acts;

a pneumatic control system operatively connected to the switch, the pneumatic control system configured to control the firing of one or more paintballs from the paintball gun; and a processor in communication with the switch and the pneumatic control system, the processor electronically monitoring valve dwell time of the pneumatic control system.

* * * * *